US011667130B2

(12) United States Patent
Haines et al.

(10) Patent No.: US 11,667,130 B2
(45) Date of Patent: Jun. 6, 2023

(54) FLUID EJECTION AND CIRCULATION

(71) Applicant: Hewlett-Packard Development Company, L.P., Spring, TX (US)

(72) Inventors: Paul Mark Haines, Corvallis, OR (US); Angela W. Bakkom, Corvallis, OR (US); Anjan Prabhat Pattathil, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 32 days.

(21) Appl. No.: 17/416,434

(22) PCT Filed: Apr. 30, 2019

(86) PCT No.: PCT/US2019/030080

§ 371 (c)(1),
(2) Date: Jun. 18, 2021

(87) PCT Pub. No.: WO2020/222834

PCT Pub. Date: Nov. 5, 2020

(65) Prior Publication Data

US 2022/0040993 A1 Feb. 10, 2022

(51) Int. Cl.
*B41J 2/18* (2006.01)
*B41J 2/175* (2006.01)

(52) U.S. Cl.
CPC ..... *B41J 2/18* (2013.01); *B41J 2/17513* (2013.01); *B41J 2/17556* (2013.01); *B41J 2/17563* (2013.01)

(58) Field of Classification Search
CPC .... B41J 2/17556; B41J 2/17513; B41J 2/175; B41J 2/20; B41J 2/18; B41J 2/17563
See application file for complete search history.

(56) References Cited

U.S. PATENT DOCUMENTS

| | | | |
|---|---|---|---|
| 5,872,584 A | 2/1999 | Hauck et al. | |
| 6,050,682 A | 4/2000 | Pawlowski et al. | |
| 6,631,983 B2 | 10/2003 | Romano, Jr. et al. | |
| 8,544,991 B2 | 10/2013 | Gray et al. | |
| 9,421,780 B2 * | 8/2016 | Nishiyama | B41J 2/18 |

(Continued)

FOREIGN PATENT DOCUMENTS

| | | |
|---|---|---|
| CN | 102026813 A | 4/2011 |
| CN | 202169106 U | 3/2012 |

(Continued)

*Primary Examiner* — An H Do
(74) *Attorney, Agent, or Firm* — Foley & Lardner LLP

(57) ABSTRACT

A fluid ejection and circulation apparatus may include a fluid ejection device, a filter to filter fluid supplied to the fluid ejection device and a pressure regulator. The pressure regulator may include a fluid chamber having a fluid port and a first port extending from the fluid chamber to the filter. The pressure regulator may further include a valve to open and close the fluid port and a compliant chamber within the fluid chamber. The compliant chamber is to undergo different inflation levels in response to fluid chamber pressure. The valve is to open and close the fluid port in response to changes in an inflation level of the compliant chamber. The fluid chamber comprises a second port cooperating with the first port to form a circulation path through the fluid chamber that is directed away from the filter.

14 Claims, 7 Drawing Sheets

(56) References Cited

U.S. PATENT DOCUMENTS

| | | | | |
|---|---|---|---|---|
| 9,649,848 | B1 | 5/2017 | Begeal et al. | |
| 9,834,005 | B2 | 12/2017 | Curran | |
| 10,906,320 | B2 * | 2/2021 | Wood | B41J 2/175 |
| 2008/0309739 | A1 | 12/2008 | Takahashi | |
| 2011/0148988 | A1 | 6/2011 | Hoisington et al. | |
| 2013/0081224 | A1 | 4/2013 | Van et al. | |
| 2017/0087867 | A1 | 3/2017 | Sato et al. | |
| 2018/0036763 | A1 | 2/2018 | Giusti et al. | |
| 2018/0093490 | A1 | 4/2018 | Kamei et al. | |
| 2018/0237651 | A1 | 8/2018 | Oriakhi et al. | |
| 2019/0077164 | A1 | 3/2019 | Yoshida | |

FOREIGN PATENT DOCUMENTS

| | | | |
|---|---|---|---|
| CN | 102762384 | A | 10/2012 |
| CN | 103381708 | A | 11/2013 |
| CN | 107185476 | A | 9/2017 |
| CN | 107206789 | A | 9/2017 |
| CN | 206765566 | U | 12/2017 |
| CN | 107614272 | A | 1/2018 |
| CN | 109572226 | A | 4/2019 |
| EP | 1905598 | A2 | 4/2008 |
| EP | 3196030 | A1 | 7/2017 |
| JP | 2006-263996 | A | 10/2006 |
| JP | 2016-155348 | A | 9/2016 |
| WO | WO-2007005265 | A1 | 1/2007 |
| WO | 2015/194495 | A1 | 12/2015 |

* cited by examiner

FLUID EJECTION AND CIRCULATION

BACKGROUND

A fluid ejection device is used to selectively eject droplets of fluid. A pressure regulator may control the pressure of the fluid being supplied to the fluid ejection device. In many devices, the fluid is first passed through a filter prior to being supplied to the fluid ejection device.

Figure 1:
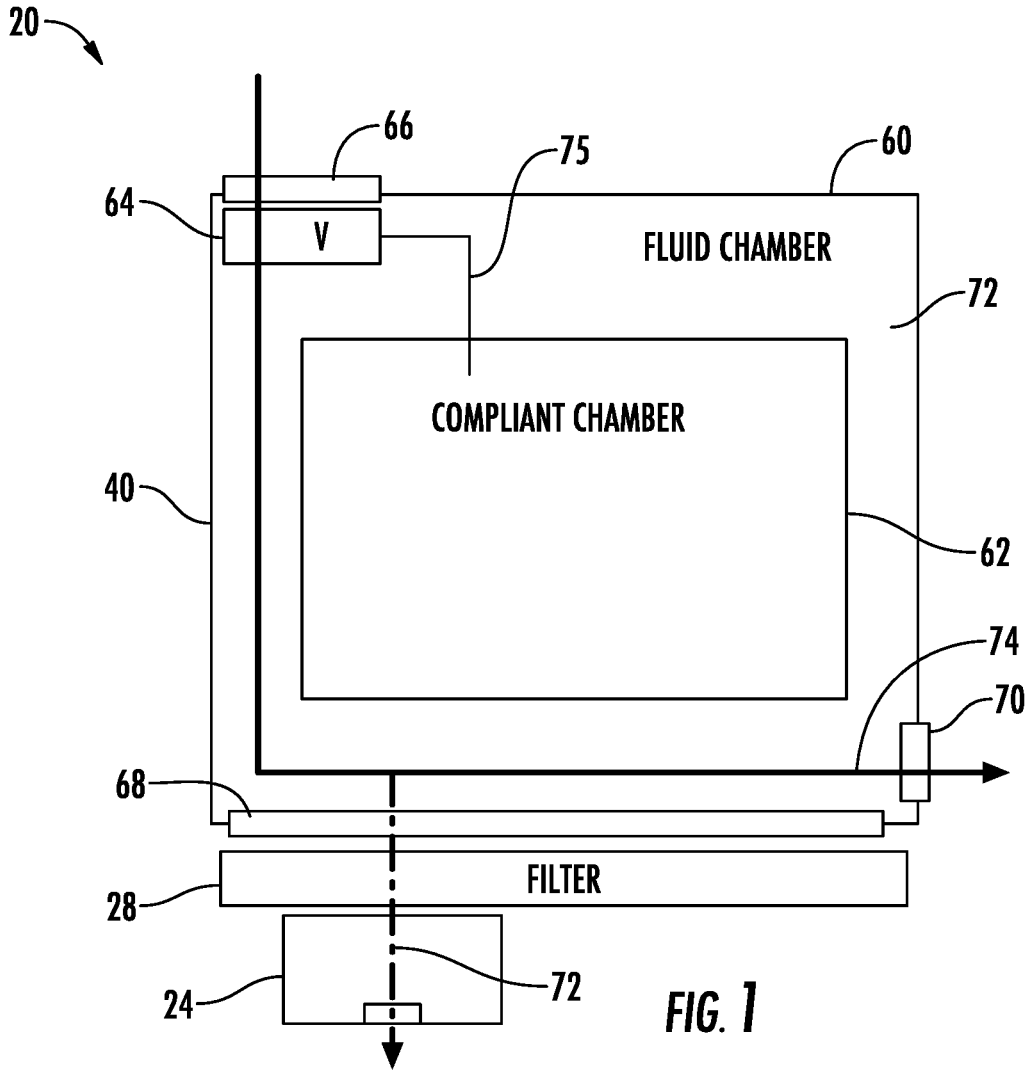
FIG. 1 is a schematic diagram illustrating portions of an example fluid ejection and circulation apparatus.

Throughout the drawings, identical reference numbers designate similar, but not necessarily identical, elements. The FIGS. are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed are example fluid ejection and circulation apparatus, fluid ejection and circulation systems and fluid circulation methods. The example apparatus, systems and methods circulate the fluid being supplied to a fluid ejection device across a chamber of a pressure regulator, prior to the fluid passing from the pressure regulator through a filter and to the fluid ejection device. Such circulation of the fluid may inhibit settling of fluid suspended particles, enhancing fluid ejection performance and facilitating the use of fluids having heavier particles and/or a higher concentration of particles.

For example, in implementations where the example fluid ejection circulation apparatus and methods are used to selectively eject droplets of printing fluid, such as ink, the apparatus and methods facilitate the use of pigment-based inks having a higher concentration of pigments and/or heavier, possibly metallic, pigments. Pigment-based inks tend to be more efficient, durable and permanent as compared to dye-based inks. Such pigments may be especially beneficial in the composition of a white ink, wherein the heavier metallic pigments and/or higher concentration of such pigments provide the white ink with a greater opacity and/or brightness. With such inks, the circulation of the fluid reduces settling of the pigments, enhancing printing performance and/or prolonging life of the fluid ejection device. Without such circulation, pigment settling may block ink flow and clogged nozzles, especially during periods of storage or nonuse of printing apparatus.

The disclosed fluid ejection and circulation apparatus may provide macro recirculation. Such macro recirculation utilizes a pressure regulator that finally controls the port pressure of the fluid flowing to the fluid ejection device. Such macro recirculation continually refreshes the fluid, reducing air and particulate levels near the fluid ejection device. As a result, fluid ejection or printing reliability is enhanced.

In some implementations, the pressure regulator maintains fluid backpressure in the ejection chamber of the fluid ejection device within a narrow range below atmospheric levels in order to avoid depriming of the nozzles or ejection orifices (leading to drooling or fluid leaking) while optimizing fluid ejection device pressure conditions for fluid ejection or printing. During non-operational periods, this pressure is maintained statically by surface tension of fluid in the ejection orifices. The pressure regulator may operate by using a formed metal spring to apply a force to an area of flexible or compliant film or chamber attached to the perimeter of the regulator chamber that is open to the atmosphere, thereby establishing a negative internal pressure for fluid containment in the apparatus. A lever on a pivot point connects the metal spring assembly to a valve such that deflection of the spring can either open or close the valve by mating it to a valve seat.

During operation, fluid is expelled from the printhead, which evacuates ink from the pressure-controlled fluid containment system of the regulator. When the pressure in the regulator reaches the backpressure set point established through design choices for spring force (i.e., spring constants K) and flexible film area, the valve opens and allows ink to be delivered from a pump connected to the port of the pressure regulator. Once a sufficient volume of ink is delivered, the spring expands and closes the valve. The regulator operates from fully open to fully closed (i.e., seated) positions. Positions in between the fully open and fully closed positions modulate the pressure drop through the regulator valve itself, causing the valve to act as a flow control element.

Disclosed is an example fluid ejection and circulation apparatus that may include a fluid ejection device, a filter to filter fluid supplied to the fluid ejection device and a pressure regulator. The pressure regulator may include a fluid chamber having a fluid port and a first port extending from the fluid chamber to the filter. The pressure regulator may further include a valve to open and close the fluid port and a compliant chamber within the fluid chamber. The compliant chamber is to undergo different inflation levels in response to fluid chamber pressure. The valve is to open and close the fluid port in response to changes in an inflation level of the compliant chamber. The fluid chamber comprises a second port cooperating with the first port to form a circulation path through the fluid chamber that is directed away from the filter.

Disclosed is an example fluid ejection and circulation system that may comprise a first fluid ejection device, a second fluid ejection device, a first pressure regulator and a second pressure regulator. The first pressure regulator may comprise a first fluid chamber having a first port and a first interior connected to the first fluid ejection device. A first compliant chamber may be provided within the first fluid chamber, wherein the compliant chamber has an inflation level that changes in response to first fluid chamber pressure. A valve may open and close the first port in response to an inflation level of the first compliant chamber.

The second pressure regulator may comprise a second fluid chamber having a second port and a second interior connected to the second fluid ejection device. The second compliant chamber within the second fluid chamber has an inflation level that changes in response to second fluid chamber pressure. A second valve may open and close the second port in response to an inflation level of the second compliant chamber. The second fluid chamber may be connected to the first fluid chamber by a third port to provide circulation from the first pressure regulator to the second pressure regulator.

Disclosed is an example fluid circulation method that may include supplying fluid to a fluid chamber of a pressure regulator and circulating the fluid through and out of the fluid chamber away from an underlying filter. In some implementations, the fluid is circulated away from the underlying filter into the fluid chamber of a second pressure regulator. In some implementations, the fluid is pulled out of the fluid chamber of the second pressure regulator while the fluid is pumped into the fluid chamber of the pressure regulator. In some implementations, an actuator is used to open a valve of the second pressure regulator to facilitate the pulling of the fluid from the fluid chamber of the second pressure regulator. In some implementations, the actuator comprises a pump or inflator that inflates a compliant chamber of the second pressure regulator to open the valve.

FIG. 1 schematically illustrates portions of an example fluid ejection and circulation apparatus 20 for the controlled ejection of fluid, wherein the fluid may be circulated within the apparatus to further mix particles suspended within the fluid to reduce settling of the particles. Apparatus 20 circulates the fluid across the chamber of a pressure regulator, prior to the fluid passing through the filter. Apparatus 20 comprises fluid ejection device 24, filter 28 and pressure regulator 40.

Fluid ejection device 24 controls the ejection of fluid from apparatus 20. Fluid ejection device 24 may include a fluid actuator adjacent an ejection chamber that displaces fluid within the ejection chamber through a corresponding ejection orifice or nozzle. In one implementation, the fluid actuator may comprise a thermal resistor which, upon receiving electrical current, heats to a temperature above the nucleation temperature of the solution so as to vaporize a portion of the adjacent solution or fluid to create a bubble which displaces fluid through the orifice. In other implementations, the fluid actuator may comprise other forms of fluid actuators. In other implementations, the fluid actuator may comprise a fluid actuator in the form of a piezo-membrane based actuator, an electrostatic membrane actuator, mechanical/impact driven membrane actuator, a magnetostrictive drive actuator, an electrochemical actuator, and external laser actuators (that form a bubble through boiling with a laser beam), other such microdevices, or any combination thereof. Although apparatus 20 is illustrated as including a single fluid ejection device 24, in other implementations, apparatus 20 may comprise multiple fluid ejection devices such as where multiple fluid ejection devices 24 are provided by a fluid ejection die having rows or columns of ejection chambers, nozzles and fluid actuators. For purposes of this disclosure, references to "a fluid ejection die" may refer to a single fluid ejection die or multiple fluid ejection dies, but for ease of explanation, the singular case is used to cover both.

Filter 28 comprises a porous structure through which fluid passes from pressure regulator 40 to fluid ejection device 24. Filter 28 removes contaminants or other unwanted particles from the fluid being supplied to fluid ejection device 24.

Pressure regulator 40 regulates the pressure of fluid being supplied to fluid ejection device 24. Pressure regulator 40 comprises fluid chamber 60, compliant chamber 62 and valve 64. Fluid chamber 60 contains compliant chamber 62. Fluid chamber 60 comprises port 66, flow passage 68 and port 70.

Port 66 comprises an opening within fluid chamber 60 communicating with an interior 72 of fluid chamber 60. Port 66 is connectable to a source of fluid which may be pumped into interior 72.

Flow passage 68 comprises a fluid connection between the interior 72 of fluid chamber 60 and filter 28. In one implementation, the flow passage 68 may be formed by an open-ended bottom of fluid chamber 60 which overlies filter 28. In another implementation is a flow passage 68 may comprise a differently sized opening or conduit leading to filter 28. Flow passage 68 allows the flow of fluid from the interior 72 through filter 28 to fluid ejection device 24.

Port 70 comprises an opening within fluid chamber 60 that allows fluid to flow out of fluid chamber 60 away from filter 28. Port 70 facilitates the circulation of fluid through, across and out of fluid chamber 60 without the fluid being directed to or towards filter 28. As a result, port 70 facilitates circulation mode in which fluid may be circulated through fluid chamber 60 of pressure regulator 40 to agitate or mix suspended particles or pigments without the fluid having to flow through filter 28 for such circulation. The fluid discharged from fluid chamber 60 during the circulation mode may be returned via port 66.

In one implementation, port 70 is positioned proximate to flow passage 68 and proximate to filter 28 provide a greater degree of fluid flow adjacent to and along filter 28. As a result, the higher concentration of particle sediment collecting near flow passage 68 and filter 28 may be stirred or mixed and resuspended. In one implementation, port 70 has a mouth having a lower edge spaced no greater than 2 mm above the passage 68 or no greater than 2 mm above the top surface of filter 28. In one implementation, the lower edge of port 70 is flush with the top surface of filter 28.

Compliant chamber 62 may comprise a flexible membrane, pouch, bag or other structure which may change in shape and volume in response to pressure changes within fluid chamber 60. In one implementation, compliant chamber 62 may comprise a flexible film along the internal sides of fluid chamber 60, the film forming a compliant chamber that is connected to atmosphere. In another implementation, compliant chamber 62 may comprise an inflatable bag captured between a pair of resiliently biased levers.

Valve 64 comprise a valve mechanism that selectively opens and closes port 66 in response to or based upon the inflation level, shape or size of compliant chamber 62 which is itself dependent upon the fluid pressure level within interior 72 of fluid chamber 60. As schematically illustrated by line 75, valve 64 is actuatable based upon the inflation level of compliant chamber 62. In one implementation, changes in the shape, size or inflation level of compliant chamber 62 move a lever which transmits the force to valve 64 to actuate valve 64. In another implementation, the size, shape or inflation level of compliant chamber 62 may be sensed, wherein the sensed inflation level causes a controller to output control signals to an actuator actuating valve 64.

In one implementation, pressure regulator 40 maintains fluid backpressure in the fluid ejection device 24 within a narrow range below atmospheric levels in order to avoid depriming of the nozzle or nozzles (leading to drooling or fluid leaking) while optimizing fluid ejection device pressure conditions for fluid ejection or printing. During non-operational periods, this pressure is maintained statically by surface tension of fluid in the nozzle. In some implementations, the pressure regulator 40 may operate by using a formed metal spring (not shown) to apply a force to an area of flexible or compliant film or chamber 62 that is open to the atmosphere, thereby establishing a negative internal pressure for fluid containment in the apparatus 20. A lever (not shown) on a pivot point connects the metal spring assembly to a valve (not shown) that opens and closes port 66 such that deflection of the spring can either open or close the valve by mating it to a valve seat.

During operation in a fluid ejection mode, fluid flows along ejection path 74 (shown in broken lines) from interior 72, through filter 28 and through fluid ejection device 24. Fluid is expelled from the apparatus 20, which evacuates fluid from the pressure-controlled fluid containment system of the regulator 40. When the pressure in the regulator 40 reaches the backpressure set point established through design choices for spring force (i.e., spring constants K) and flexible film area, the valve 64 opens and allows fluid to be delivered from a pump connected to the port of the pressure regulator. Once a sufficient volume of fluid is delivered, the spring expands and closes the valve 64. The regulator 40 operates from fully open to fully closed (i.e., seated) positions. Positions in between the fully open and fully closed positions modulate the pressure drop through the regulator valve itself, causing the valve to act as a flow control element.

In one implementation, pressure regulator 40 may be actuated to a circulation mode. During the circulation mode, fluid is not ejected by fluid ejection device 24. In contrast, the fluid is circulated through port 70 along the illustrated circulation path 74, without being directed to filter 28. In one implementation, the fluid may be pulled from the interior 72 of fluid chamber 60 through port 70. The fluid circulated through port 70 may be recirculated back into fluid chamber 60 for subsequent ejection. The circulation of fluid through, across and out of fluid chamber 60, without passing through filter 28, may serve to agitate or mix particle suspended within the fluid to delay or inhibit settling of the particles. Because such circulation occurs within fluid chamber 60, the fluid being circulated does not pass through filter 28, inhibiting settling of particles within or on filter 28. As a result, the life of filter 28 may be extended. Moreover, because such circulation occurs above filter 28 or within chamber 60, such circulation may be less susceptible to pressure spikes, enhancing the performance of apparatus 20.

Figure 2:
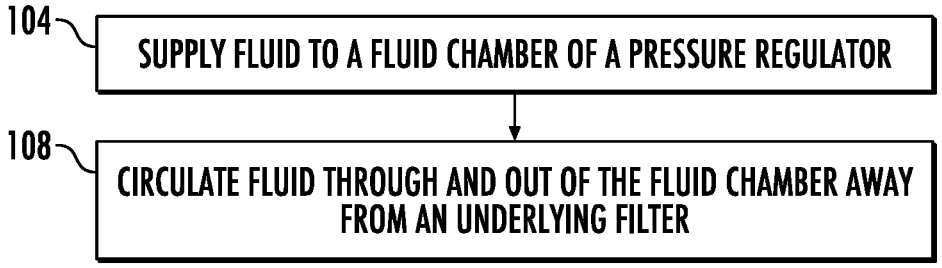
FIG. 2 is a flow diagram of an example fluid circulation method.

FIG. 2 is a flow diagram illustrating portions of an example fluid circulation method 100. Method 100 circulates fluid within and across the fluid chamber of a pressure regulator to further mix particles suspended within the fluid to reduce settling of the particles, increasing the robustness of apparatus 20. Although method 100 is described in the context of being carried out by apparatus 20, it should be appreciated that method 100 may likewise be carried out with any of the systems or apparatus disclose hereafter or with similar systems or apparatus.

As indicated by block 104, fluid is supplied to fluid chamber 60 of pressure regulator 40. In one implementation, the fluid being supplied may comprise a fluid having larger or heavier particles or a higher concentration of particles that may be more prone to settling. For example, in one implementation, the fluid being supplied may comprise a printing fluid, such as an ink, containing heavier pigments or a higher concentration of pigments that may render the ink more susceptible to pigment settling. In one implementation, the printing fluid may comprise a white ink having heavier metallic particles or a higher concentration of metallic particles that provide the white ink with enhanced white color.

As indicated by block 108, the fluid may be circulated through and out of the fluid chamber 60 away from the underlying filter 28. In other words, the fluid flow is not directed towards filter 28 or through filter 28. Such circulation of fluid through, cross and out of fluid chamber 60, without being directed towards filter 28, may occur during a circulation mode at times during which fluid is not being supplied to ejection chamber 44 through flow passage 68. Such circulation agitates or mixes suspended particles within the fluid to reduce or inhibit settling of the particles. By reducing settling of the particles, nozzle or orifice health is maintained and fluid ejection performance is enhanced.

Figure 3:
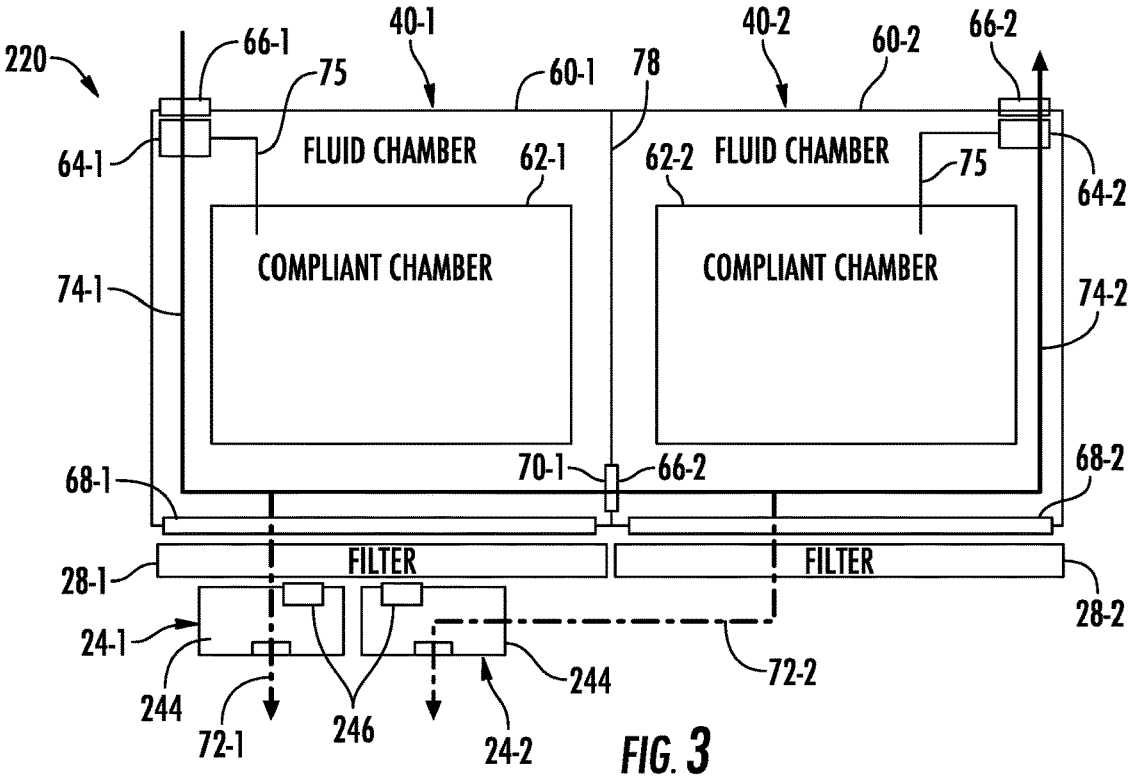
FIG. 3 is a schematic diagram illustrating portions of an example fluid ejection and circulation apparatus.

FIG. 3 schematically illustrates portions of an example fluid ejection and circulation apparatus 220. Apparatus 220 provides controlled ejection of fluid, wherein the fluid may be circulated within the apparatus to further mix particles suspended within the fluid to reduce settling of the particles. Apparatus 220 circulates the fluid across the chambers of two pressure regulators, prior to the fluid passing through a filter. In one implementation, apparatus 220 may be formed as part of a fluid ejection unit or cartridge. Apparatus 220 comprises fluid ejection devices 24-1, 24-2 (collectively referred to as fluid ejection devices 24), filters 28-1, 28-2 (collectively referred to as filters 28) and pressure regulators 40-1, 40-2 (collectively referred to as pressure regulators 40).

Each of fluid ejection device 24 controls the ejection of fluid from apparatus 220. Each of fluid ejection devices 24 is similar to fluid ejection device 24 described above. Each of fluid ejection device 24 comprises an ejection chamber 244 and a fluid actuator 246. In the example illustrated, fluid ejection device 24-1 receives fluid that that has passed through pressure regulator 40-1 and through filter 28-1. Fluid ejection device 24-2 receives fluid that is passed through pressure regulator 40-2 and through filter 28-2.

Filters 28 are each similar to filter 28 described above. Each of filters 28 comprises a porous structure through which fluid passes from a respective pressure regulator 40 to a respective fluid ejection device 24. Filters 28 remove contaminants or other unwanted particles from the fluid being supplied to fluid ejection devices 24. Although illustrated as two separate components. In some implementations, filters 28-1 and 28-2 may be provided by a single unitary fluid filtering structure. In some implementations, filters 28 may be omitted.

Pressure regulators 40-1, 40-2 regulate the pressure of fluid being supplied to fluid ejection devices 24-1, 24-2. Each of pressure regulators 40 is similar to pressure regulator 40 described above. Pressure regulators 40-1, 40-2 comprise fluid chamber 60-1, 60-2, compliant chambers 62-1, 62-2 and valves 64-1, 64-2, respectively. Each of fluid chambers 60 contains one of compliant chambers 62. Compliant chambers 62 may each comprise a flexible membrane, pouch, bag or other structure which may change in shape and volume in response to pressure changes within the associated fluid chamber 60-1, 60-2.

Fluid chamber 60-1 comprises a fluid port 66-1, a flow passage 68-1 and a second fluid port 70-1. Fluid port 66-1, flow passage 68-1 and fluid port 70-1 are similar to port 66, flow passage 68 and port 70, respectively, described above. Valve 64-1 is likewise similar to valve 64 described above.

Fluid port 70-1 extends from the interior fluid chamber 60-1, wherein port 66-1 and port 70-1 makes fluid circulation path 74-1 through fluid chamber 60-1. In one implementation, port 66-1 and port 70-1 are located at opposite ends or sides of fluid chamber 62-1 to promote circulation across a greater portion of the length or width of fluid chamber 60-1. In one implementation, fluid port 70-1 is located proximate to the floor of fluid chamber 60-1, such as proximate to a bottom wall of chamber 60-1 or proximate to the top surface of filter 28-1. As a result, such circulation is more likely to agitate or remix particles that may have already settled or begun to settle (sometimes referred to as sediment) towards the bottom of fluid chamber 60-1. In one implementation, port 70-1 is spaced no greater than 2 mm from a top of filter 28-1 or the otherwise formed bottom of fluid chamber 60-1.

In the example illustrated, fluid port 70-1 also serves as a port 66-2 for fluid chamber 60-2 of pressure regulator 40-2. Fluid being circulated into fluid chamber 60-2 through port 66-2 may flow through and across fluid chamber 60-2 before being discharged through port 66-2. In one implementation, fluid chambers 60-1 and 60-2 are separated by an intervening or intermediate wall 78, wherein ports 70-1 and port 66-2 are formed by an opening extending through wall 78.

Similar to port 70-1, port 66-2 of fluid chamber 60-2 is formed along a floor of fluid chamber 60-2. In some implementations, chamber 60-2 has no floor, wherein filter 28-2 forms a floor of chamber 60-2 and wherein flow passage 68-2 is a general open connection between the interior of chamber 60-2 and filter 28-2.

When apparatus 220 is in a fluid ejection mode, fluid may be supplied to fluid chamber 60-1 and 60-2 through ports 66-1 and 66-2, respectively. Such fluid passes through fluid chamber 60-1, 60-2, through filters 28-1, 28-2 and to fluid ejection devices 24-1, 24-2 for ejection as indicated by ejection flow paths 72-1 and 72-2. Flow passage 68-2 forms a fluid ejection path 72-2 (shown in broken lines) along which fluid flows out of pressure regulator 40-1, through filter 28-1 and through orifice 48-2 of ejection device 24-2.

In the above example, fluid circulation paths 74-1 and 74-2 collectively span two fluid chamber 60-1, 60-2 of two different pressure regulators 40-1, 40-2. In such an implementation, fluid may be supplied into fluid chamber 60-1 and pulled from fluid chamber 62-2 to provide such an elongated circulation path to reduce particle sediment. In other implementations, pressure regulators 40-1 and 40-2 may be spaced from one another and connected by an elongate fluid passage. In other implementations, apparatus 220 may include more than two pressure regulators, wherein a fluid circulation path may be formed so as to extend through and across each of the more than two pressure regulators. For example, apparatus 220 may include three or more pressure regulators arranged in series, wherein fluid supplied to the first pressure regulator the series and withdrawn from the last pressure regulator of the series, passing through the an intermediate pressure regulator or multiple intermediate pressure regulators sandwiched between the first and last pressure regulators of the series.

Figure 4:
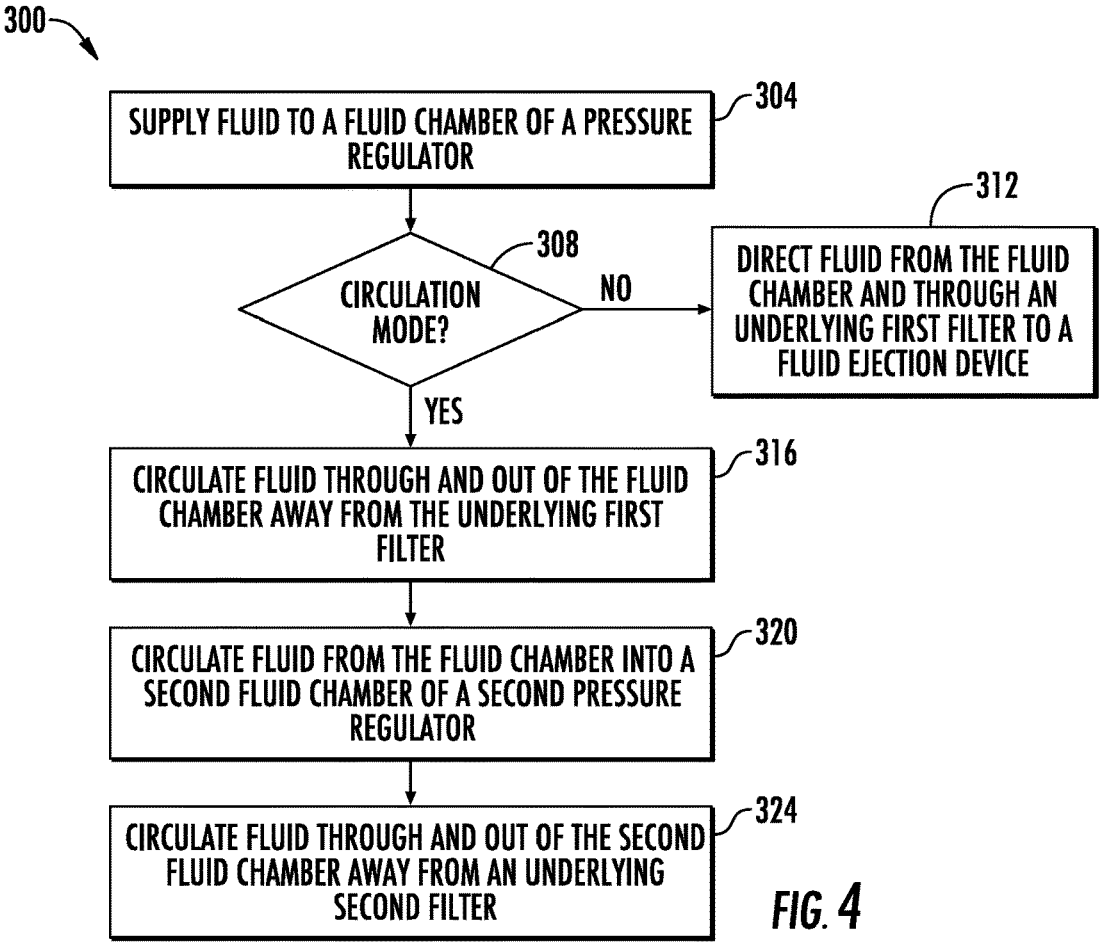
FIG. 4 is a flow diagram of an example fluid ejection and circulation method.

FIG. 4 is a flow diagram of an example fluid circulation method 300. Method 300 circulates fluid within and across the fluid chambers of two pressure regulator to further mix particles suspended within the fluid to reduce settling of the particles, increasing the robustness of apparatus 220. Although method 300 is described in the context of being carried out by apparatus 220, it should be appreciated that method 300 may likewise be carried out with any of the systems or apparatus disclose hereafter or with similar systems or apparatus.

As indicated by block 304, fluid supplied to fluid chamber 60-1 of pressure regulator 40-1. In one implementation, the fluid being supplied may comprise a fluid having larger or heavier particles or a higher concentration of particles that may be more prone to settling. For example, in one implementation, the fluid being supplied may comprise a printing fluid, such as an ink, containing heavier pigments or a higher concentration of pigments that may render the ink more susceptible to pigment settling. In one implementation, the printing fluid may comprise a white ink having heavier metallic particles or a higher concentration of metallic particles that provide the white ink with enhanced white color.

As indicated by block 308, a determination is made as to whether apparatus 220 is in a circulation mode, a mode in which fluid is circulated through pressure regulators 40 without being directed to fluid ejection devices 24. As indicated by block 312, in response to a controller determining that apparatus 220 is not in the circulation mode, fluid is directed from the fluid chamber 60-1 and through the underlying filter 28-1 to the fluid ejection device when 24 1. In some implementations, fluid may be additionally supplied through port 66-2 into fluid chamber 60-2, through filter 28-2 and to fluid ejection device 24-2 for ejection.

As indicated by block 316, in response to apparatus 220 being in the circulation mode, fluid within fluid chamber 60-1 is circulated through and out of fluid chamber 60-1, through port 70-1, away from the underlying filter 28-1. As indicated by block 320, the fluid is then circulated from the fluid chamber 60-1 into fluid chamber 60-2 of the second pressure regulator 40-2. As indicated by block 324, the fluid is finally circulated through and out of the second fluid chamber 60-2 through port 66-2. In one implementation, the fluid is pulled through port 66-2. In one implementation, an actuator is used to actuate valve 64-2 to open port 66-2. In one implementation, the actuator may comprise a pump or inflator that inflates compliant member 62-2 to change its inflation level and thereby cause valve 64-2 to open port 66-2 for the circulation of fluid out of fluid chamber 60-2. The fluid circulated out of chamber 60-2 may be circulated back to the apparatus 220 for ejection through either port 66-1 or 66-2.

Figure 5A:
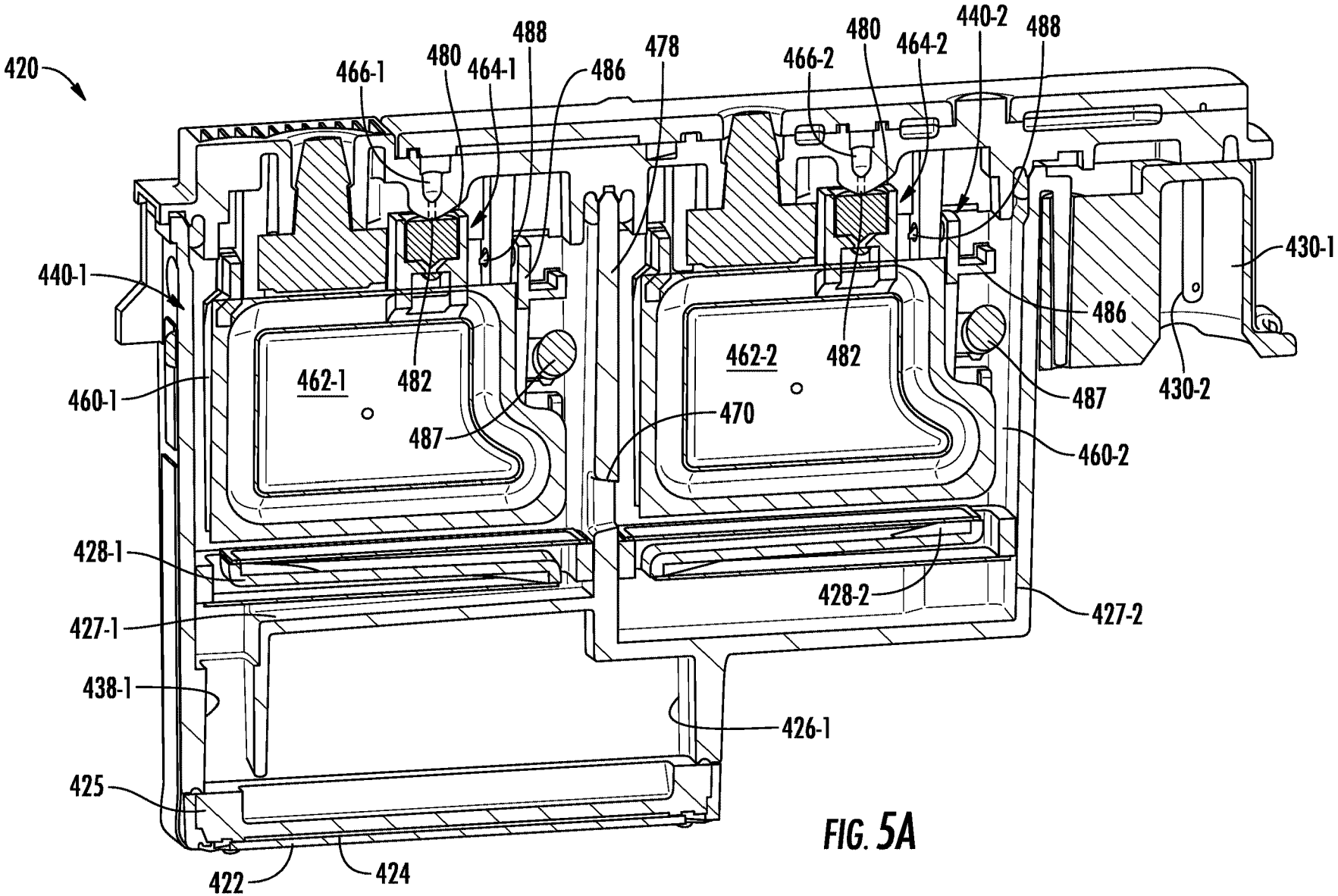
FIGS. 5A and 5B are sectional views of an example fluid ejection and circulation apparatus.
Figure 5B:
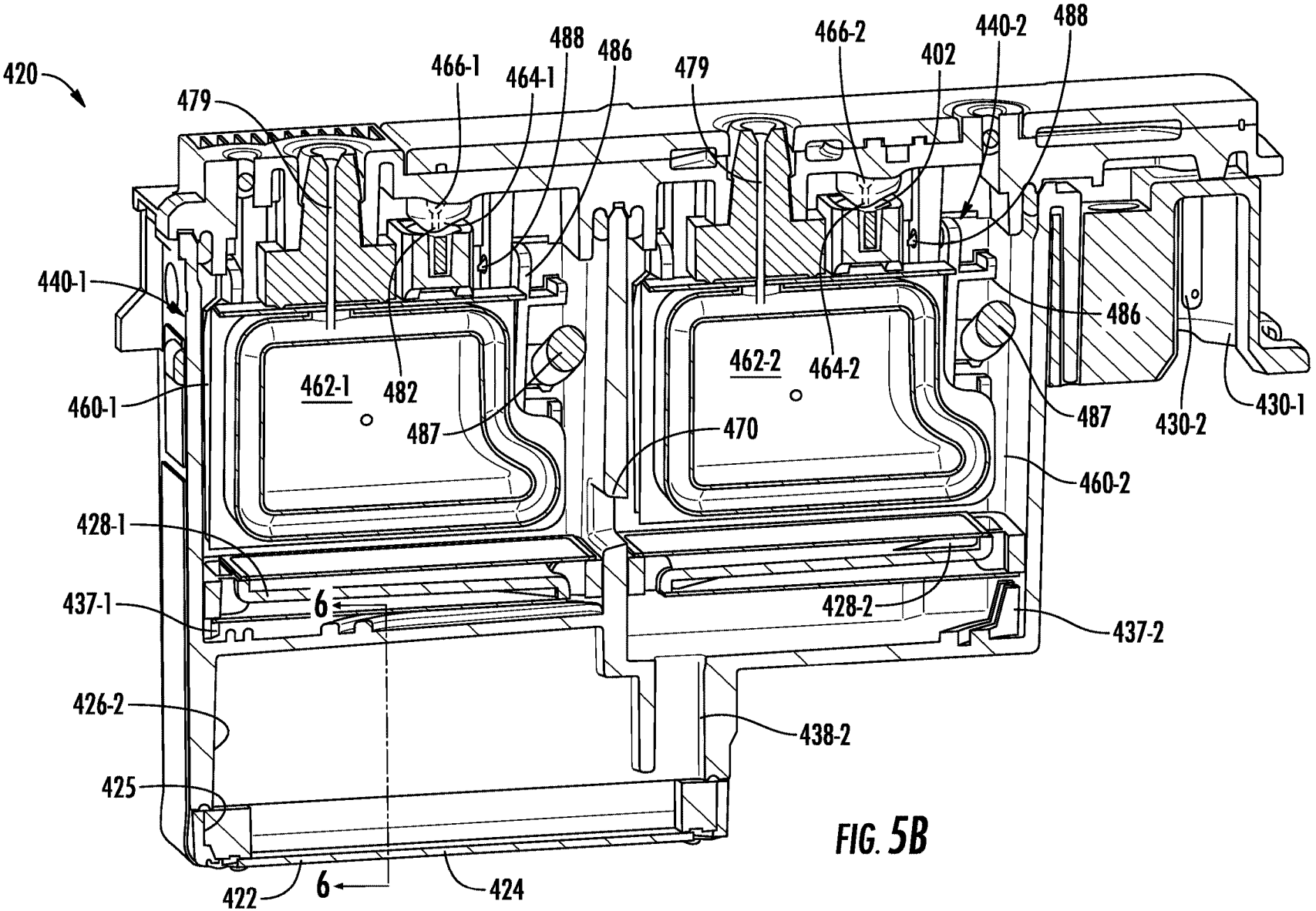

FIGS. 5A and 5B are sectional views illustrating portions of an example fluid ejection and circulation apparatus 420. Apparatus 420 may be in the form of a print or fluid ejection module which may be a removable and replaceable component of a larger overall fluid ejection system. Apparatus 420 comprises fluid ejection die 422, providing an array of fluid ejection devices 424, die carrier 425, standpipes 426-1, 426-2 (collectively referred to as standpipes 426), filter chambers 427-1, 427-2 (collectively referred to as filter chambers 427), filters 428-1, 428-2 (collectively referred to as filters 428), fluid needles 430-1, 430-2 (collectively referred to as fluid needles 430) and pressure regulators 440-1, 440-2 (collectively referred to as pressure regulators 440).

Figure 6:
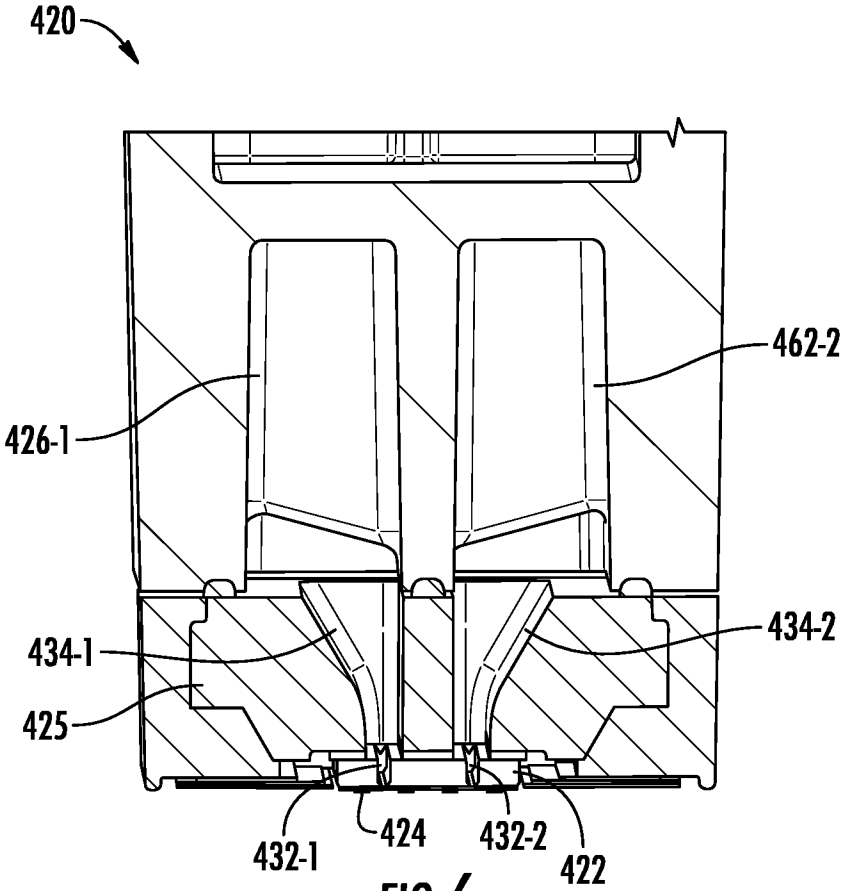
FIG. 6 is a sectional view of a lower portion of the fluid ejection and circulation apparatus of FIGS. 5A and 5 B take along line 6-6 of FIG. 5B.

FIG. 6 is a sectional view illustrating fluid ejection die 422, die carrier 4245 and standpipes 426 in greater detail. Fluid ejection die 422 comprises a fluid ejection die supporting a series or array of fluid ejection devices 424. Each of fluid ejection device 424 may be similar to fluid ejection device 24 described above. In the example illustrated, fluid ejection die 422 comprises a pair of slots or a series of fluid feed holes 432-1, 432-2 through which fluid is supplied to the individual fluid ejection devices 424.

Die carrier 425 is bonded to die 422 and supports die 422 below standpipes 426-1 and 426-2. In one implementation, the material forming standpipes 426 as a first coefficient of thermal expansion, the material forming die 422 has a second coefficient of thermal expansion and the material forming die carrier 425 has a third coefficient of thermal expansion between that of die 422 and the material standpipes 426. In one implementation, die 422 is formed from silicon whereas the material standpipes 426 is formed from a polymer in the material die carrier 425 is formed from a ceramic. As shown by FIG. 6, die carrier 425 includes slots 434-1 and 434-2 which supply fluid from standpipes 426-1 and 426-2 to fluid feed holes 432-1 and 422-2, respectively.

Standpipes 426 extend side-by-side parallel to one another above die carrier 425 and above ejection die 422. Standpipes 426 receive fluid from filter chambers 427-1, 427-2, respectively, after the fluid has passed through filters 428-1 and 428-2, respectively (shown in FIGS. 5A and 5B). In particular, standpipe 426-1 receives fluid from filter chamber 427-1 through a fluid conduit 438-1 as seen in FIG. 5A. Standpipe 426-2 receives fluid from filter chamber 427-2 through a fluid conduit 438-2 as seen in FIG. 5B.

Filters 428 are similar to filters 28 described above. Filter 428-1 filters the fluid supplied from pressure regular 440-1 to filter chamber 437-1 and ultimately to fluid feed holes 432-1 shown in FIG. 6. Filter 428-2 filters fluid supplied from pressure regulator 440-2 to filter chamber 437-2 and ultimately to fluid feed holes 432-2 as shown in FIG. 6. In the example illustrated, filters 428-1 and 428-2 form the floor of the respective fluid chambers of pressure regulator 440-1 and 440-2.

Pressure regulators 440-1 and 440-2 are substantially identical to one another. Pressure regulators 440-1, 440-2 comprises fluid chambers 460-1, 460-2, compliant chambers 462-1, 462-2, valve 464-1, 464-2. Fluid chambers 460-1, 460-2 contain compliant chambers 462-1, 462-2, respectively. Fluid chambers 460-1, 460-2 comprises ports 466-1, 466-2, respectively, through which fluid may flow into and out of the respective fluid chambers 460.

In the example illustrated, fluid chambers 460-1 and 460-2 are connected to one another by connecting port 470. Port 470 extends through an intervening wall 478 separating fluid chambers 460. Port 470 facilitates the circulation of fluid from the interior of fluid chamber 460-1 into the interior of fluid chamber 460-2 when apparatus 420 is in a circulation mode. As a result, port 470 facilitates a circulation mode in which fluid may be circulated through fluid chamber 460-1 of pressure regulator 440-1 to agitate or mix suspended particles or pigments without the fluid having to flow through filter 428-1 for such circulation. Port 470 further facilitates circulation of fluid through fluid chamber 460-2 to and out of port 466-2 to agitate or mix suspended particles or pigments without the fluid having to flow through filter 428-2 for such circulation.

In one implementation, port 470 is positioned proximate to each of filters 428 to provide a greater degree of fluid flow adjacent to and along the filters 428. As a result, the higher concentration of particle sediment collecting near filters 28 may be stirred or mixed and resuspended. In one implementation, port 470 has a mouth having a lower edge space no greater than 2 mm above the top surface of filters 28. In one implementation, the lower edge of port 70 is flush with the top surface of filters 28.

Compliant chambers 462 each comprise a flexible membrane, pouch, bag or other structure which may change in shape and volume in response to pressure changes within the respective fluid chambers 460. In one implementation, each of compliant chambers 462 may comprise a flexible bag having an interior connected to atmosphere by an atmospheric port 479 (shown in FIG. 5*b*).

Valves 464 each comprise valve mechanism that selectively opens and closes its respective ports 466-1, 466-2 (portions of which are shown in broken lines due the shown section) in response to or based upon the inflation level, shape or size of the associated compliant chamber 462 which is itself dependent upon the fluid pressure level within interior of the associated fluid chamber 460. As shown by FIGS. 5A and 5B, each of ports 466 passes through a crown 480 against which a valve seat 482 may bear against to seal the respective port 466. In the example illustrated, the valve seat 482 of each of pressure regulators 440 pivots between port closing or sealing position and a port opening position by use of a lever that engages compliant chamber 462. In one implementation, the valve seat 482 is formed from a resilient a rubber-like material. Examples of such materials include silicon rubbers, fluoro silicate elastomers, or blends thereof.

Figure 7:
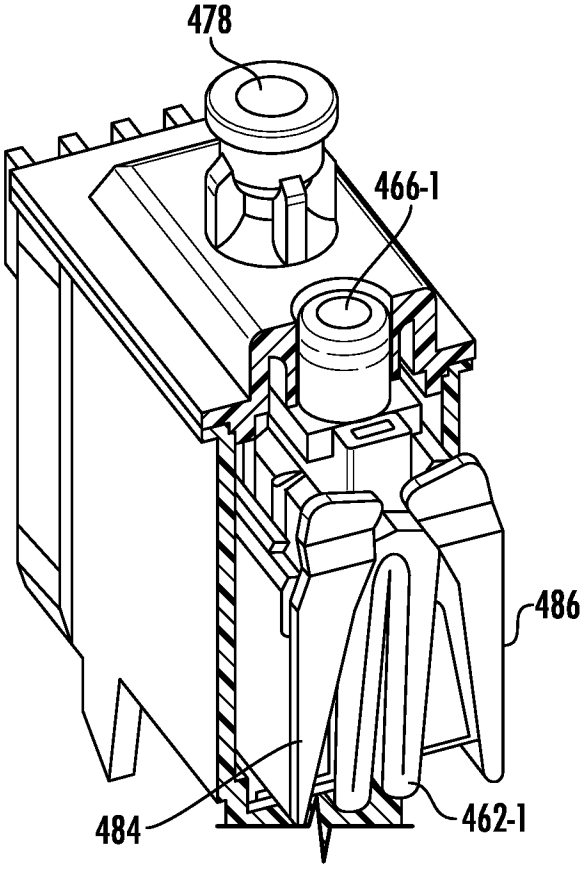
FIG. 7 is a fragmentary sectional view of a portion of an example pressure regulator of the apparatus of FIGS. 5A and 5B.
Figure 9:
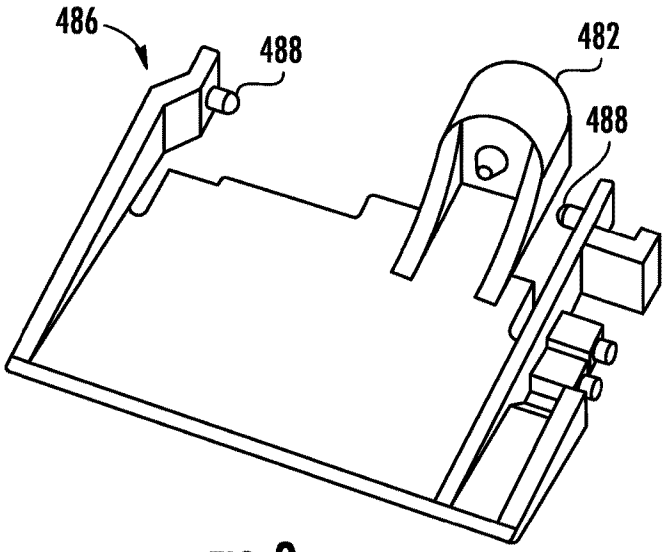
FIG. 9 is a perspective view illustrating an example lever and valve seat of the pressure regulator of FIG. 7.
Figure 8:
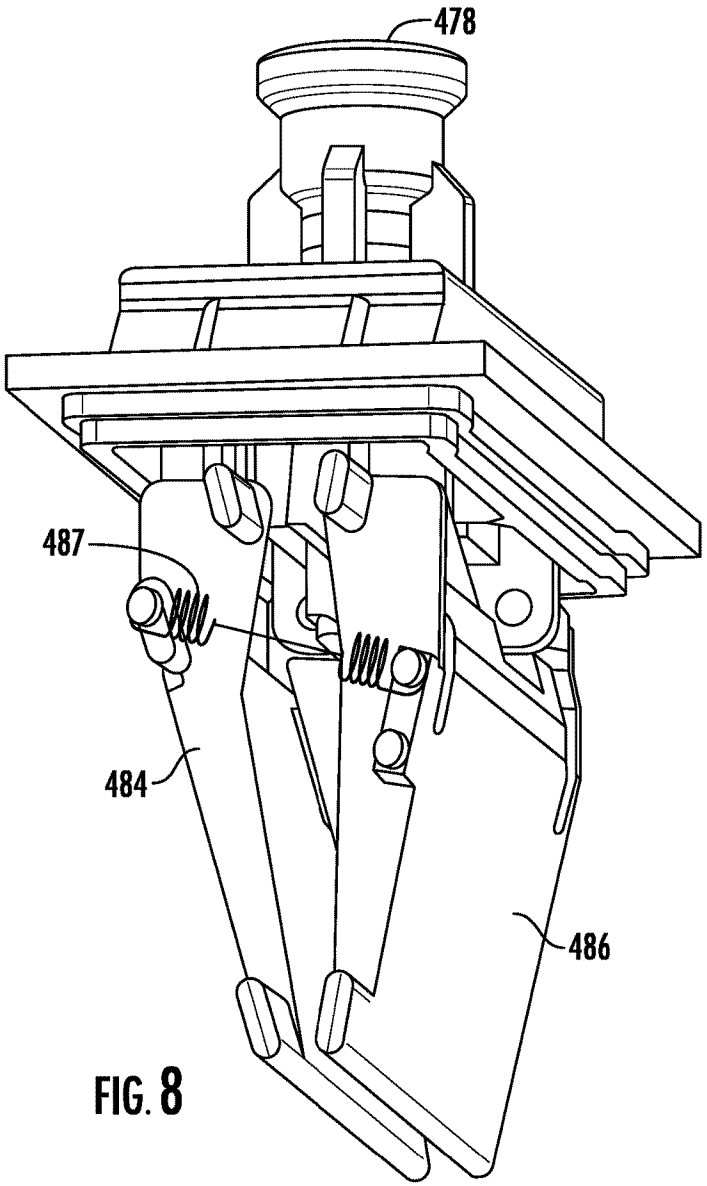
FIG. 8 is a perspective view illustrating portions of the example pressure regulator of FIG. 7.

FIGS. 7-9 illustrate portions of pressure regulator 440-1 in more detail. As noted above, pressure regular 440-2 is substantially similar to pressure regulator 440-1. As shown by FIG. 7, compliant chamber 462-1 may be in the form of an inflatable bag captured between a pair of levers 484, 486. Levers 484, 486 are resiliently biased towards one another and against compliant chamber 462-1 by a tension spring 487 (shown in FIG. 8). As shown by FIG. 9, lever 486 further supports valve seat 482. Lever 486 pivots about axles 488 which are pivotally received within the body of apparatus 420 is shown by FIGS. 5A and 5B. Depending upon the inflation level of compliant chamber 462-1, valve seat 482 may be pivoted into sealing engagement with crown 480 or out of sealing engagement with respect to crown 480.

Figure 10:
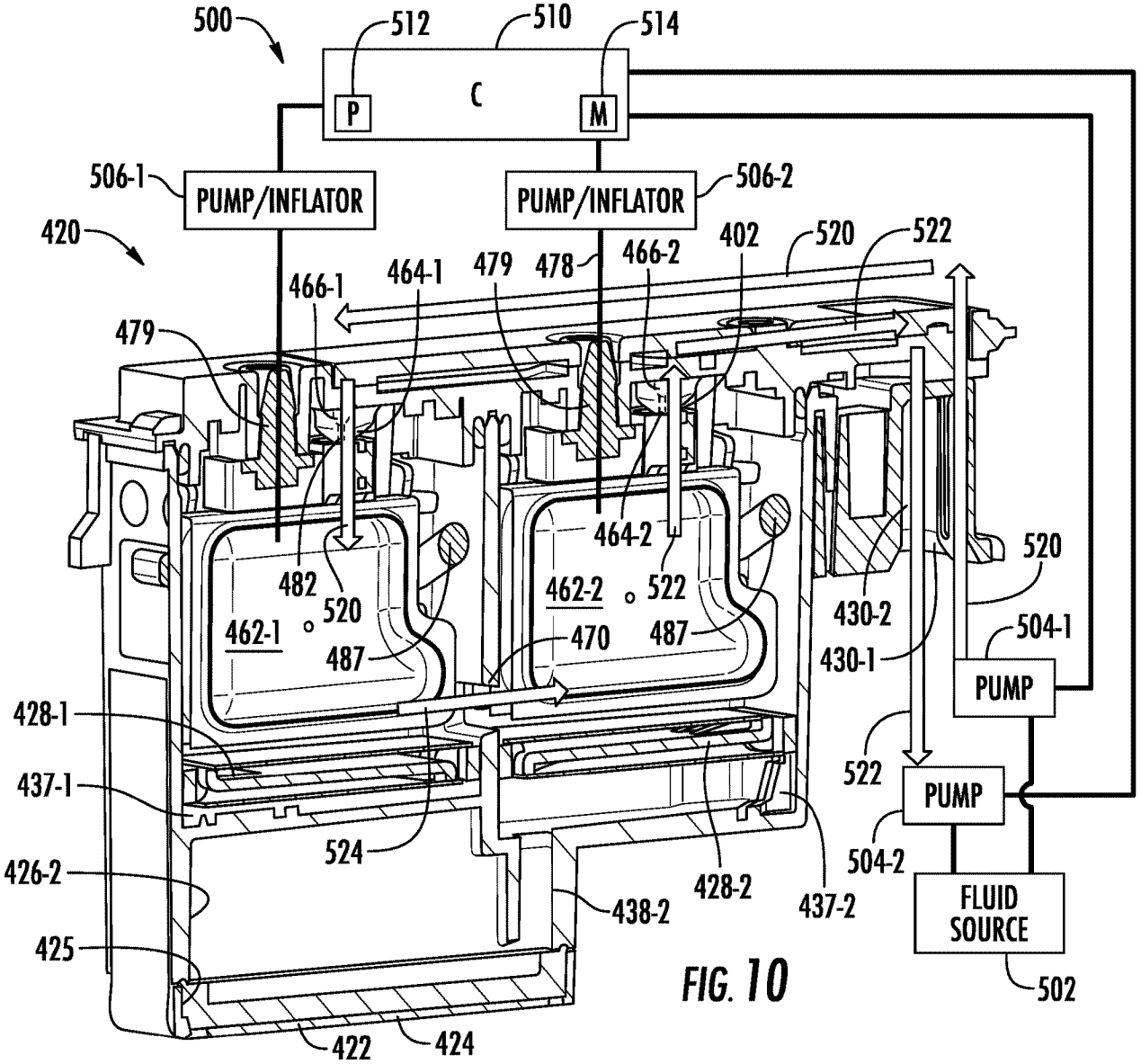
FIG. 10 is a sectional view of the fluid ejection and circulation apparatus of FIGS. 5A and 5B as part of a fluid ejection and circulation system operating in a circulation mode.

FIG. 10 illustrates fluid ejection and circulation apparatus 420 provided as part of a larger fluid ejection and circulation system 500. In addition to apparatus 420, system 500 comprises external fluid source 502, fluid pumps 504-1, 504-2 (collectively referred to as fluid pumps 504), pumps/inflators 506-1, 506-2 (collectively referred to as pumps/inflators 506) and controller 510. External fluid source 502's serves as a reservoir containing fluid to be supplied to each of pressure regulators 440 and ultimately to fluid ejection die 422. Pumps 504 selectively pump fluid from fluid source 502 to fluid chambers 460-1, 460-2 or pull fluid from fluid chambers 460-1, 460-2, respectively, back into fluid source 502. Pumps/inflators 506 are selectively connectable to their respective compliant chambers 462-1 and 462-2. Pump/inflators 506 close off the interior of their respective compliant chambers from atmosphere and controllably inflate their respective compliant chambers 462 to open the respective valves 464-1 and 464-2. In some implementations, when the apparatus is in the circulation mode, a rubber or elastomeric boot having an inflation port connected to an inflator is moved over and seals an atmospheric port of the compliant chamber that is to be inflated to open the valve.

Controller 510 actuates system 500 and apparatus 420 between the fluid ejection mode or state in a fluid circulation mode or state. Controller 510 may comprise a processing unit 512 that follows instructions contained in a non-transitory computer-readable medium 514. Following instructions contained in memory 514, processing unit 512 may output control signals to control the operation of pumps 504 and pump/inflators 506 to actuate apparatus 420 between the fluid ejection mode and the fluid circulation mode.

In the fluid ejection mode, each of the pressure regulators 440 maintains fluid backpressure in the fluid ejection die 422 within a narrow range below atmospheric levels in order to avoid depriming of the nozzles are ejection orifices (leading to drooling or fluid leaking) while optimizing fluid ejection device pressure conditions for fluid ejection or printing. During non-operational periods, this pressure is maintained statically by surface tension of fluid in the ejection orifices. The pressure regulators 440 operate by using spring 487 to apply a force to an area of their respective compliant chambers 462 which are open to the atmosphere through atmospheric ports 479, thereby establishing a negative internal pressure for fluid containment in the apparatus. Lever 486 pivots in response to inflation or deflation of the associated compliant chamber 462 to seat or unseat valve seat 482 with respect to the associated crown 480 to seal or open the respective port 466.

During ejection of fluid, fluid is expelled by fluid ejection die 422 which evacuates fluid from the pressure-controlled fluid containment system of the regulators 440. When the pressure in the respective regulator 440 reaches the backpressure set point established through design choices for spring force (i.e., spring constants K) and flexible film area, the valve seat 482 opens and allows fluid to be delivered from pump 504-1, 504-2 connected to the port 466-1 and port 466-2, respectively. The regulators 440 each operate from fully open to fully closed (i.e., seated) positions. Positions in between the fully open and fully closed positions modulate the pressure drop through the regulator valve itself, causing the valve mechanism 464 to act as a flow control element.

In the circulation mode, fluid is not ejected from apparatus 420. FIG. 10 illustrates apparatus 420 in a fluid circulation mode in which fluid is supplied into fluid chamber 460-1, passes through port 470, circulates through fluid chamber 462 and is discharged or pulled from fluid chamber 460-2. In such a circulation mode, controller 510 causes pump 504-1 to supply fluid from fluid source 502 through internal flow passages and through port 466-1 into fluid chamber 460-1 as indicated by arrows 520. Controller 510 causes pump/inflators 506-2 to disconnect port 479 of compliant chamber 462-2 from atmosphere and to alternatively inflate compliant chamber 462-2 through port 479 two point such that valve seat 482 is pivoted out of sealing engagement with crown 480 about port 466-2, opening port 466-2. Controller 510 further output control signals causing pump 504-2 to apply a vacuum pressure to pull or draw fluid from fluid chamber 460-2 through the opened port 466-2 and back into fluid source 502 as indicated by arrows 522. As a result, a complete circulation path is formed wherein fluid from fluid source 502 is supplied to fluid chamber 460-1 which flows through port 470 (as indicated by arrow 524) into fluid chamber 460-2. Fluid within fluid chamber 460-2 is drawn or pulled through port 466-2, returning to fluid source 502. Such circulation bypasses filters 428-1 and 428-2.

In the example illustrated, system 500 may provide such circulation in a reverse direction compared to that shown in FIG. 10. To provide such a reverse circulation flow, controller 510 causes pump 504-2 to supply fluid from fluid source 502 through internal flow passages and through port 466-2 into fluid chamber 460-1 as indicated by arrows 520. Controller 510 causes pump/inflators 506-1 to disconnect port 479 of compliant chamber 462-1 from atmosphere and to alternatively inflate compliant chamber 462-1 through port 479 to an extent such that valve seat 482 is pivoted out of sealing engagement with crown 480 about port 466-1, opening port 466-1. Controller 510 further outputs control signals causing pump 504-1 to apply a vacuum pressure to pull or draw fluid from fluid chamber 460-1 through the opened port 466-1 and back into fluid source 502, opposite to the direction indicated by arrows 522. As a result, a complete circulation path is formed wherein fluid from fluid source 502 is supplied to fluid chamber 460-2 which flows through port 470 (opposite to the direction indicated by arrow 524 into fluid chamber 460-1. Fluid within fluid chamber 460-1 is drawn or pulled through port 466-1, returning to fluid source 502. Such circulation bypasses filters 428-1 and 428-2.

Although the present disclosure has been described with reference to example implementations, workers skilled in the art will recognize that changes may be made in form and detail without departing from the spirit and scope of the claimed subject matter. For example, although different example implementations may have been described as including features providing additional benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A fluid ejection and circulation apparatus comprising:
- a fluid ejection device;
- a filter to filter fluid to be supplied to the fluid ejection device; and
- a pressure regulator comprising:
  - a fluid chamber comprising:
    - a first port for connection to a fluid source;
    - a flow passage connected to the filter;
  - a compliant chamber within the fluid chamber that is to undergo different inflation levels in response to fluid chamber pressure; and
  - a valve to open and close the first port in response to changes in an inflation level of the compliant chamber,
  - wherein the fluid chamber comprises a second port cooperating with the first port to form a circulation path through the fluid chamber that is directed away from the filter.

2. The fluid ejection and circulation apparatus of claim 1, wherein the filter forms a portion of a floor of the fluid chamber below the pressure regulator and wherein the second port extends across from a space within the fluid chamber between the filter and the pressure regulator.

3. The fluid ejection and circulation apparatus of claim 2, wherein the second port is no greater than 2 mm above the floor formed by the filter.

4. The fluid ejection and circulation apparatus of claim 1 further comprising:
- a fluid ejection die providing the fluid ejection device; and
- a standpipe between the filter and the printhead die.

5. The fluid ejection and circulation apparatus of claim 1 further comprising:

a second fluid ejection device;

a second filter to filter fluid supplied to the second fluid ejection device; and a second pressure regulator comprising:

a second fluid chamber;

a third port;

a second valve to open and close the third port; and a second compliant chamber within the second fluid chamber and operably coupled to the second valve to actuate the valve in response to fluid pressure changes within the second fluid chamber.

6. The fluid ejection and circulation apparatus of claim 5, wherein the fluid chamber and the second fluid chamber are separated by a wall and wherein the second port comprises an opening through the wall.

7. A fluid ejection and circulation method comprising:

supplying fluid to a fluid chamber of a pressure regulator;

circulating fluid across and out of the fluid chamber away from an underlying filter;

circulating fluid from the fluid chamber into a second fluid chamber of a second pressure regulator; and circulating fluid through and out of the second fluid chamber away from a second underlying filter.

8. The fluid ejection and circulation method of claim 7 further comprising pulling fluid out of the second fluid chamber while pumping fluid into the fluid chamber.

9. A fluid ejection and circulation system comprising:

a first fluid ejection device;

a second fluid ejection device;

a first pressure regulator comprising:

a first fluid chamber having a first port and a first interior connected to the first fluid ejection device;

a first compliant chamber within the first fluid chamber, the first compliant chamber having an inflation level that changes in response to first fluid chamber pressure; and a valve to open and close the first port in response to an inflation level of the first compliant chamber;

a second pressure regulator comprising:

a second fluid chamber having a second port and a second interior connected to the second fluid ejection device, the second fluid chamber being connected to the first fluid chamber by a third port;

a second compliant chamber within the second fluid chamber, the second compliant chamber having an inflation level that changes in response to second fluid chamber pressure; and a second valve to open and close the second port in response to an inflation level of the second compliant chamber.

10. The fluid ejection and circulation system of claim 9 further comprising a first filter below the first pressure regulator to filter fluid flowing from the first fluid chamber to the first fluid ejection device and a second filter below the second pressure regulator to filter fluid flowing from the second fluid chamber to the second fluid ejection device.

11. The fluid ejection and circulation system of claim 10, wherein the third port is no greater than 2 mm above the first filter.

12. The fluid ejection and circulation system of claim 10, wherein the third port has a lower edge level with a top surface of the first filter.

13. The fluid ejection and circulation system of claim 9 further comprising:

a first pump to pump fluid into the first fluid chamber;

an actuator to open the second valve while fluid is flowing from the first fluid chamber into the second fluid chamber; and a third pump to pull fluid from the second fluid chamber while the first pump is pumping fluid into the first.

14. The fluid ejection and circulation system of claim 13, wherein the actuator comprises a third pump to adjust an inflation level of the second compliant chamber.

* * * * *